United States Patent [19]
Choi
[11] 4,212,426
[45] Jul. 15, 1980

[54] PROTECTIVE HOUSING FOR IRRIGATION SPRINKLERS

[75] Inventor: Mansam Choi, Duarte, Calif.

[73] Assignee: Anthony Manufacturing Corp., Azusa, Calif.

[21] Appl. No.: 965,341

[22] Filed: Dec. 1, 1978

[51] Int. Cl.[2] ..... B05B 3/14; B05B 15/10
[52] U.S. Cl. ..... 239/230; 239/288.5
[58] Field of Search ..... 239/201, 203–206, 239/230, 288, 288.3, 288.5

[56] References Cited

U.S. PATENT DOCUMENTS

| | | | |
|---|---|---|---|
| 3,361,364 | 1/1968 | Purtell | 239/288.3 X |
| 4,010,901 | 3/1977 | Sheets | 239/288.3 X |

FOREIGN PATENT DOCUMENTS

| | | | |
|---|---|---|---|
| 644041 | 9/1934 | Fed. Rep. of Germany | 239/201 |

*Primary Examiner*—Robert W. Saifer
*Attorney, Agent, or Firm*—Fulwider, Patton, Rieber, Lee & Utecht

[57] ABSTRACT

A protective housing is provided which entirely encloses an impact drive irrigation sprinkler to prevent adjacent vegetation from interfering with normal operation of the sprinkler and to minimize damage due to vandalizing. In the case of pop-up type sprinklers, a lower portion of the housing is tapered to enhance the ability of the sprinkler to move axially through vegetation, such as ivy and the like, and the housing is arranged to entirely enclose the sprinkler in all operating and non-operating positions.

9 Claims, 4 Drawing Figures

PROTECTIVE HOUSING FOR IRRIGATION SPRINKLERS

BACKGROUND OF THE INVENTION

This invention relates generally to rotary irrigation sprinklers, and more particularly, to a rotary sprinkler of the impact drive type, intended for use in an environment where the sprinkler is likely to come in contact with adjacent vegetation.

As is well known in the art, when a rotary irrigation sprinkler is employed in an environment where the sprinkler is likely to come in contact with adjacent vegetation, such as when employed for irrigating an ivy ground cover or the like, the vegetation will frequently become entangled on the sprinkler or otherwise interfere with the normal operation thereof. For example, this interference can take the form of contacting the drive arm of a sprinkler and disrupting its free swinging motion, or becoming entangled with and causing malfunction of the trip mechanism of a part circle sprinkler.

This problem is particularly troublesome where the sprinkler is mounted for pop-up operation. That is, when the sprinkler is arranged to move axially between a downwardly retracted non-operating position and an upwardly extended operating position, adjacent vegetation frequently interferes, not only with the normal operation of the sprinkler in its operating position, but also with the axial movement between its non-operating and operating positions.

Prior art devices have been proposed which provide for partial enclosure of a sprinkler, but none has entirely enclosed all of the sprinkler mechanism. Accordingly, these prior devices include, for example, exposed levers for adjusting part circle operation, which levers can easily become entangled on adjacent vegetation. It will also be appreciated that these levers are readily available for unauthorized tampering, as by vandals.

Another method for dealing with these problems has been to provide a stationary subterranean housing into which a pop-up sprinkler is retracted when not in operation. This type of housing usually includes a cover attached to the top of the sprinkler, which cover closes the housing when the sprinkler is in its retracted position, thereby entirely enclosing the sprinkler.

This subterranean housing functions satisfactorily for preventing adjacent vegetation from becoming entangled on the sprinkler while the sprinkler is not in use, and the housing also inhibits unauthorized tampering with the sprinkler. However, such a housing does not move with the sprinkler to its upwardly extended operating position, and as a result, the sprinkler is subject to substantial interference from adjacent vegetation when in operation. Further, experience with such housings has shown that, although the cover attached to the sprinkler assists in pushing vegetation aside as the sprinkler moves to its extended position, the same vegetation frequently catches on the exposed sprinkler and is drawn into the housing as the sprinkler is retracted, thereby preventing complete retraction of the sprinkler into the housing.

Accordingly, there has existed a need for a convenient and effective device for preventing interference with the operation of an impact drive irrigation sprinkler by adjacent vegetation. As will become apparent from the following, the present invention satisfies that need.

SUMMARY OF THE INVENTION

The present invention resides in a new and improved housing for an impact drive rotary irrigation sprinkler within which the sprinkler is entirely enclosed during all operating and non-operating positions of the sprinkler. Moreover, the housing of the present invention is relatively inexpensive to manufacture, is trouble free and reliable in use, and serves to protect the enclosed sprinkler from interference by adjacent vegetation and unauthorized tampering, such as by vandals.

More specifically, a downwardly facing concave upper portion of the housing is disposed over the top of the sprinkler and secured to the sprinkler body for rotation therewith. An opening is provided through the upper portion of the housing and aligned with the sprinkler nozzle and a reaction member of the impact arm in order to permit irrigation water ejected by the sprinkler to exit the housing. Since the upper portion of the housing rotates with the sprinkler body, the opening is always held in alignment with the sprinkler nozzle.

In order to fully enclose the sprinkler within the housing, a lower portion of the housing extends from the bottom of the sprinkler up to a position adjacent to and immediately below the upper portion of the housing. The lower portion of the housing is generally frusto-conical with the apex end of the cone oriented downwardly and closely surrounding the water supply riser adjacent the bottom of the sprinkler and increasing in diameter upwardly to a diameter which substantially coincides with the upper portion of the housing. Preferably, the lower portion of the housing is releasably secured to the water supply riser and arranged to be moved downwardly along the riser when released to permit access to the sprinkler.

It will be appreciated that enclosing either a pop-up or fixed type sprinkler within a housing as described, will permit quieter operation than non-enclosed impact sprinklers while providing a neat and attractive external appearance of the sprinkler. Further, the housing of the present invention will facilitate operation of an irrigation sprinkler at sub-freezing temperatures. Other features and advantages of the present invention will become apparent from the following detailed description, taken in conjunction with the accompanying drawings, which illustrate, by way of example, the principles of the invention.

DETAILED DESCRIPTION

Figure 1:
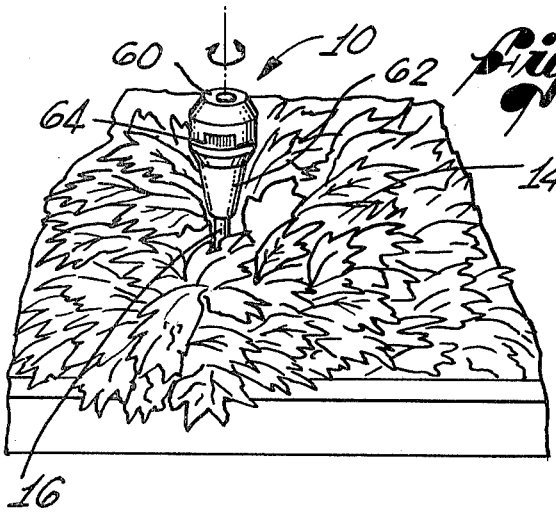
FIG. 1 is a perspective view of a sprinkler housing embodying the present invention, and illustrated assembled on an anti-side-splash impact drive type sprinkler.
Figure 3:
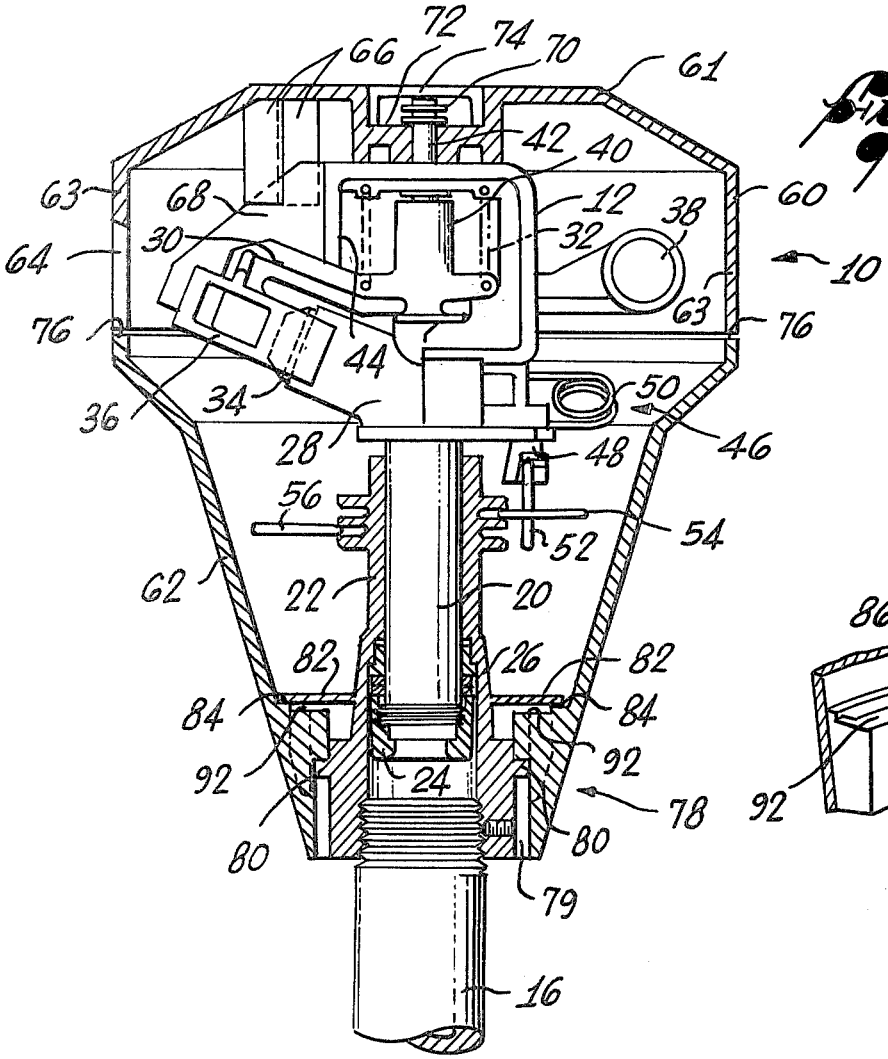
FIG. 3 is a further enlarged, partly sectional view of the housing of the present invention, and illustrated as mounted on the anti-side-splash sprinkler.

As shown in the exemplary drawings, the present invention is embodied in a housing, indicated generally by reference numeral 10 in FIG. 1, which housing is intended for use in conjunction with a conventional impact drive rotary irrigation sprinkler 12 (FIG. 3). The housing 10 is particularly adapted for use with such a sprinkler when the sprinkler is mounted in an environment including relatively dense and heavy vegetation, such as an ivy ground cover 14, or the like.

Figure 2:
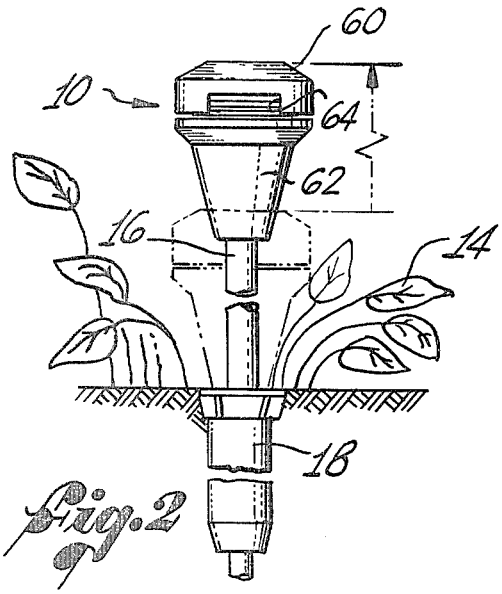
FIG. 2 is an enlarged, fragmentary view of the sprinkler and housing of FIG. 1, and illustrated as assembled for conventional pop-up operation.

In this instance, as can best be seen in FIG. 2, the sprinkler 12 is shown mounted for pop-up operation to the upper end portion of a tubular, movable riser 16 disposed for reciprocation between raised and lowered positions above a conventional pop-up actuator 18. By this arrangement, when the sprinkler is not in use it rests generally at ground level and within the ground cover 14, and when in operation, the sprinkler is raised above the ground cover to the position shown in FIG. 1. It will be appreciated that the housing 10 of this invention is also suitable for use with a sprinkler mounted on a stationary riser, or with a sprinkler arranged to pop up from and retract into a subterrainean receptacle (not shown).

As can best be seen in FIG. 3, the sprinkler 12 includes a downwardly extending tubular stem 20 disposed within a bearing sleeve 22 threadably received on the upper end of the riser 16. The stem 20 is mounted for rotation within the sleeve 22 by a retaining nut 14 and a bearing 26 of conventional design.

The sprinkler 12 herein is of the anti-side splash type disclosed in co-pending application Ser. No. 877,375, filed on Feb. 13, 1978. The housing 10 of the present invention is suitable for use with other anti-side splash sprinklers, such as those disclosed in U.S. Pat. No. 3,022,012, issued Feb. 20, 1962 to C. R. Sharp et al and in the 1977–1978 Irrigation Equipment Catalog published by Rain Bird Sprinkler Mfg. Corp. of Glendora, Calif.

Generally, the sprinkler 12 includes a sprinkler body 28, preferably formed of metal or plastic, an impact arm 30, and an arm spring 32. The sprinkler body 28 receives water through the riser 16 on which it is mounted for rotation, and ejects the water in an upward and outward direction through a nozzle 34. The impact arm 30 includes a reaction member 36 disposed at one end of the arm, and a counter weight 38 disposed at the other end, and is mounted for rotation about a vertical axis coincident with the vertical axis of rotation of the sprinkler body 28. In this instance, the impact arm 30 includes an upstanding centrally apertured sleeve 40 through which projects a pivot pin 42 about which the impact arm rotates relative to the sprinkler body 28. The arm spring 32 is disposed about the sleeve 40 and is coupled between the impact arm 30 and the sprinkler body 28 in such a manner as to bias the reaction member 36 of the impact arm into alignment with the nozzle 34 and against an anvil 44 affixed to the sprinkler body.

The sprinkler 12 is driven in a conventional manner for impact-drive sprinklers. The water stream from the nozzle 34 intercepts the reaction member 36 of the impact arm 30 to effect a rotational deflection of the drive arm and rotate the reaction member in a first direction out of the stream and away from the anvil 44. During the rotational arm deflection, the arm spring 32 is compressed until the force of the spring slows, and ultimately reverses the rotational movement of the impact arm 30. The reaction member 36 of the impact arm 30 then is driven back into the stream and impacts the anvil 44 to thereby apply an increment of angular motion to the sprinkler body 28 in the forward drive direction. Continued oscillation of the impact arm 30 into and out of the stream thereby drives the sprinkler 28 incrementally in a forward direction about its vertical axis. Further, anti-side splash sprinklers are arranged so that the stream of water intercepted by the reaction member 36 exits the reaction member in a direction substantially parallel to the stream exiting the nozzle 34.

To effect part-circle operation, the sprinkler 12 includes a reversing mechanism, indicated generally by reference numeral 46 in FIG. 3. The operation of the reversing mechanism is well known in the art. Generally, the reversing mechanism 46 includes a trip arm 48 pivotally mounted to the body 28 and coupled by an over-center spring 50 to a reversing arm (not shown) also pivotally mounted to the body. The trip arm 48 and reversing arm are coupled together by the over-center spring 50 in such a manner that the trip arm and reversing arm are each movable between two stable positions, and the spring acts to hold the trip arm and reversing arm in one or the other of their two stable positions. Movement of the trip arm and reversing arm between their stable positions is effected by means of a trip extension 52 which depends downwardly from the trip arm to engage adjustable trip stops 54 and 56 disposed about the upper end of the bearing sleeve 22.

To arrange the sprinkler 12 for full circle operation, the trip extension 52 can be rotated to a substantially horizontal position as shown in broken line in FIG. 3. In this way, the extension 52 will not engage either of the trip stops 54 or 56 and will therefore rotate continuously.

In accordance with the present invention, the impact drive sprinkler 12 is entirely enclosed within the relatively small, attractive housing 10 in all operating positions of the sprinkler. Thus, the sprinkler can be arranged to pop up and down through ivy or other vegetation without the vegetation interfering with normal operation of the sprinkler, as by catching on such members as the part-circle trip stops 54 or 56, or the drive arm 30. Further, the sprinkler and housing of the present invention are trouble free and reliable in use, and are relatively vandal resistant since the entire sprinkler mechanism, including various adjustable parts, is enclosed within the housing.

Toward the foregoing ends, a downwardly facing concave upper portion 60 of the housing 10 is secured to the top of the sprinkler 12 for rotation therewith, and the enclosure of the sprinkler is completed by a lower portion 62 of the housing, which is releasably secured to the bottom of the bearing sleeve 22. The top portion 60 of the housing includes a generally flat top 61 and a downwardly extending annular wall 63 having an opening 64 to permit the irrigation water ejected from the sprinkler to exit the housing. As can best be seen in FIGS. 1 and 2, the opening 64 is laterally elongated to permit both the stream of water ejected by the nozzle 34, and the generally parallel stream ejected by the reaction member 36 to exit the housing 10. If desired, two separate openings can be provided for this purpose.

In order to maintain the opening 64 in alignment with the nozzle 34 during rotation of the sprinkler 12, the top portion 60 of the housing is arranged to rotate with the sprinkler. Toward this end, a pair of fingers 66 project downwardly from the inside of the top portion 60, and these fingers engage both sides of a flange 68 formed integrally on the body 28 of the sprinkler.

The top portion 60 of the housing is secured to the top of the sprinkler 12 by being received over an upward extension of the pin 42 and retained thereon by a conventional snap ring 70. To inhibit unauthorized removal of the top portion 60, the snap ring 70 can be secured to the pin 42 in a recess 72 in the top of the housing, and a dustcover 74 can be disposed in the recess covering the pin and snap ring.

In order to perform the desired function of preventing the sprinkler from becoming entangled on adjacent vegetation, the lower portion 62 of the housing has a generally frusto-conical external shape with the apex end of the cone oriented downwardly. In this way, as a pop-up sprinkler moves from its operating position down into the vegetation to its non-operating position, the lower portion of the housing tends to urge the vegetation laterally away from the sprinkler. Further, in order to completely enclose the sprinkler and provide a neat and attractive appearance, the top edge 76 of the lower portion 62 is sized to match the bottom of the upper portion 60 and is disposed immediately below the upper portion 60.

For the purpose of providing access to the adjustable controls of the sprinkler, such as the part-circle trip stops 54 and 56, and the trip extension 52, the lower portion 62 of the housing 10 is releasably secured to the bottom of the bearing sleeve 22 by a bayonet-type attachment, indicated generally by reference numeral 78 in FIG. 3. By this arrangement, when it is desired to gain access to the adjustable controls of the sprinkler, the lower portion 62 can be released from the bearing sleeve 22 and moved downwardly along the riser 16 away from the sprinkler 12 to provide the desired access. This arrangement also allows access to a setscrew 79 installed through the bearing sleeve 22 in order to lock the bearing sleeve to the riser 16. The setscrew 79 further protects the sprinkler from unauthorized tampering and possible removal from the riser 16.

To cooperate with the housing attachment means, the bearing sleeve 22 has a plurality of radially extending, circumferentially spaced lugs 80 and a plurality of radially extending, circumferentially spaced spring fingers 82 above each lug. Relatively few of these lugs and fingers are required, and they are preferably evenly spaced around the bearing sleeve 22, such as three sets of lugs and fingers spaced 120 degrees apart, or four sets spaced 90 degrees apart. Further, the vertical distance between the lugs 80 and fingers 82 is carefully arranged to cooperate with the housing as described below.

Figure 4:
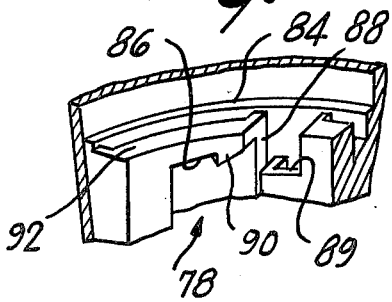
FIG. 4 is a further enlarged, fragmentary, partly sectional view illustrating a means for securing a portion of the housing to the riser.

As can best be seen in FIG. 4, the attachment means 78 includes an annular ledge 84 formed around the inside wall of the housing at a diameter to receive the distal ends of the fingers 82 thereon. Vertically and radially spaced from the ledge 84 are a plurality of retaining recesses 86 arranged to receive the lugs 80, and the vertical distance between the ledge 84 and recess 86 is slightly greater than the vertical distance between the lugs 80 and spring fingers 82 for a purpose which is discussed below.

In operation of the attachment means 78, the lower portion 62 of the housing is raised around the bearing sleeve 22 and rotationally oriented so that the lugs 80 each pass into a slot 88. As the housing continues to be raised, moving the lugs 80 into the slots 88, the spring fingers 82 contact the ledge 84, and the lugs contact the bottom surface 89 of the slot 88 before the fingers are deflected beyond their elastic limit. By making the distance between the ledge 84 and recess 86 slightly greater than the distance between the lugs and fingers, the fingers must be deflected upwardly before the housing can be rotated to seat the lugs 80 in the recesses 86. This is advantageous because the spring fingers 82 will then apply a small force biasing the lugs 80 into contact with the recesses 86 when the lower portion of the housing is attached to the bearing sleeve 22. The spring force provided by the fingers 82 prevents vertical vibration of the lower portion of the housing when the sprinkler is in operation. If desired, a small lip 90 can be provided adjacent the recess 86 to prevent inadvertent movement of the lug 80 out of the recess 86 thereby releasing the lower portion 62 of the housing from the bearing sleeve 22.

To remove the lower portion of the housing 62 from the bearing sleeve 22, the housing is moved upwardly a short distance, deflecting the spring fingers 82 upwardly, and then the housing is rotated until the lugs 80 are aligned in the slots 88. In this position, the lower portion 62 of the housing can be moved downwardly along the riser 16 and away from the sprinkler 12.

In order to prevent the fingers 82 from being broken during attachment or removal of the lower portion 62 of the housing, an inner ledge 92 is located radially inwardly and slightly below the ledge 84. By this arrangement, as the housing is moved upwardly deflecting the fingers 82, the inner ledge 92 will contact the lower surface of the fingers at a point near the bearing sleeve 22 where the fingers can withstand a much greater force.

In normal operation of the sprinkler 12, some splashing of water will occur inside the housing as the drive arm 30 moves into and out of the stream ejected from the nozzle 34. In order to permit this relatively small quantity of water to exit the housing, sufficient clearance is provided between the lower portion 62 of the housing and the bearing sleeve 22 adjacent the attachment means 78 to permit the water to drain out of the lower portion of the housing around the riser 16. Of course, if greater drainage were desired, a drain hole, or a series of drain holes (not shown) could be provided through the wall of the lower portion 62.

From the foregoing, it will be appreciated that the present invention provides a neat and attractive housing 10 which entirely encloses an impact drive rotary irrigation sprinkler 12 in all operating positions of the sprinkler, and the housing is particularly arranged to permit the sprinkler to pop up and down through ivy or other vegetation without the vegetation interfering with normal operation of the sprinkler. Further, the housing 10 can be fabricated conveniently and economically as, for example, of a molded plastic material, and the lower portion 62 of the housing completely encloses all adjustable parts of the sprinkler and is releasably secured to the water supply riser 16 to provide access to those adjustable parts.

While a particular form of the invention has been illustrated and described, it will be apparent that various modifications can be made without departing from the spirit and scope of the invention.

I claim:

1. In an irrigation apparatus including an impact drive rotary sprinkler mounted for rotation about the axis of a riser, said sprinkler including a nozzle for ejecting a stream of water from the sprinkler and an impact arm having a reaction member which periodically enters said stream to impart rotary motion to said sprinkler; the improvement comprising:

a housing entirely surrounding said sprinkler and having at least one opening through said housing adjacent to and aligned with said nozzle and said reaction member to permit said stream ejected from said nozzle and from said reaction member to exit said housing, said housing including a downwardly facing generally concave cover overlying said sprinkler, said cover including a top and a downwardly extending annular wall containing said opening, said housing further including a generally frusto-conical lower wall surrounding a lower portion of said sprinkler and arranged with the apex end of said frusto-conical wall facing downwardly and closely surrounding said riser adjacent the bottom of said sprinkler, and the larger diameter end of said frusto-conical wall is sized to cooperate with said downwardly extending annular wall of said generally concave cover, and is positioned adjacent to and immediately below said annular wall; and means on said housing for engaging said sprinkler, said means extending downwardly from said top and engaging an upper portion of said sprinkler thereby causing said cover to rotate with said sprinkler and maintaining said opening in alignment with said nozzle and said reaction member during operation of said sprinkler.

2. The improvement as set forth in claim 1 wherein said sprinkler is arranged to move upwardly to an operating position and downwardly to a non-operating position, and said housing surrounds said sprinkler in both said operating and said non-operating positions.

3. The improvement as set forth in claim 1 wherein said lower wall is separate from said concave cover and includes a means for releasably securing said apex end of said wall to said riser.

4. The improvement as set forth in claim 3 wherein said lower wall, upon release from said riser, is arranged to be moved downwardly away from said sprinkler, thereby permitting access to said sprinkler.

5. The improvement as set forth in claim 3 wherein said means for releasably securing said lower wall of said riser is a bayonet type attachment.

6. The improvement as set forth in claim 5 wherein said bayonet attachment includes a spring means for resiliently retaining said lower wall in attachment with said riser.

7. The improvement as set forth in claim 6 wherein said spring means includes a plurality of spring fingers having distal ends arranged to engage a first ledge on said lower wall, and said lower wall further including an inner ledge arranged to engage said fingers at a point spaced inwardly from said distal ends when said fingers are deflected, whereby damage to said fingers is substantially prevented.

8. A housing for enclosing an impact drive irrigation sprinkler mounted for rotation about the axis of a movable riser, said riser arranged for movement between an extended operating position and a retracted, non-operating position, said housing comprising:

a generally frusto-conical lower portion with the apex end of the cone oriented downwardly and closely surrounding the bottom of said sprinkler adjacent said riser, said cone increasing in radius upwardly around said sprinkler until the radius of said cone exceeds the radius from said axis to which any part of said sprinkler extends;

an upper portion extending from the top of said lower portion and overlying the top of said sprinkler thereby enclosing that part of the sprinkler not enclosed by said lower portion;

at least one opening in said housing adjacent a nozzle of said sprinkler to permit water from said nozzle to exit said housing; and means securing said housing to said sprinkler whereby said housing entirely encloses said sprinkler in both said operating and non-operating positions.

9. A housing as set forth in claim 8 wherein said lower portion is formed as a separate member from said upper portion; said opening is formed in said upper portion, and said upper portion is secured to said sprinkler for rotation therewith; and said lower portion is arranged to be releasably secured to said riser.

* * * * *